United States Patent [19]

LaDelfa et al.

[11] 4,445,976

[45] May 1, 1984

[54] METHOD OF ENTRAINED FLOW DRYING

[75] Inventors: Christopher LaDelfa, Calabasas Park; John F. Nutter, Encino, both of Calif.

[73] Assignee: Tosco Corporation, Santa Monica, Calif.

[21] Appl. No.: 310,650

[22] Filed: Oct. 13, 1981

[51] Int. Cl.[3] ..... C10B 57/08; C10B 57/10

[52] U.S. Cl. ..... 201/41; 34/10; 432/14; 432/15

[58] Field of Search ..... 201/31, 33, 41, 43; 34/10, 57 R; 432/14, 15, 58; 414/160, 786

[56] References Cited

U.S. PATENT DOCUMENTS

| | | | |
|---|---|---|---|
| 2,956,347 | 10/1960 | Gordon | 34/10 |
| 3,192,068 | 6/1965 | Brandt | 34/10 |
| 3,316,155 | 4/1967 | Holowaty et al. | 201/34 |
| 3,484,364 | 12/1969 | Hemminger | 201/31 |
| 3,843,458 | 10/1974 | Kemmetmueller | 201/31 |
| 3,884,620 | 5/1975 | Rammler | 34/10 |
| 3,925,190 | 12/1975 | Whitcombe et al. | 201/12 |
| 4,174,947 | 11/1979 | Delessard et al. | 432/15 |
| 4,178,150 | 12/1979 | Flockenhaus et al. | 432/14 |

*Primary Examiner*—Bradley Garris

*Attorney, Agent, or Firm*—David J. Oldenkamp; Lyle J. Schlyer

[57] ABSTRACT

An improved process and system for drying moist particulate carbonaceous materials. The invention has particular application to staged drying processes wherein the particulate material is entrained in one or more serially connect hot gas streams having a temperature above the degradation point of the carbonaceous material. The improvement includes providing contactors between the stages which intimately mix and contact the variously sized particles resulting in partial cooling of the smaller hot and dry particles and partial heating of the larger cool and relatively moist particles. The contactor may be provided by a rotating drum, moving bed, fixed bed or fluidized bed. The contactors prevent overheating of small particles during moisture removal and reduce hydrocarbon loss from small particle devolatilization. Removal of smaller dry particles or fines is provided from the contactors with the separated out fines being combusted to provide at least a portion of the heat necessary for operating the drying system while at the same time reducing heat loads.

17 Claims, 1 Drawing Figure

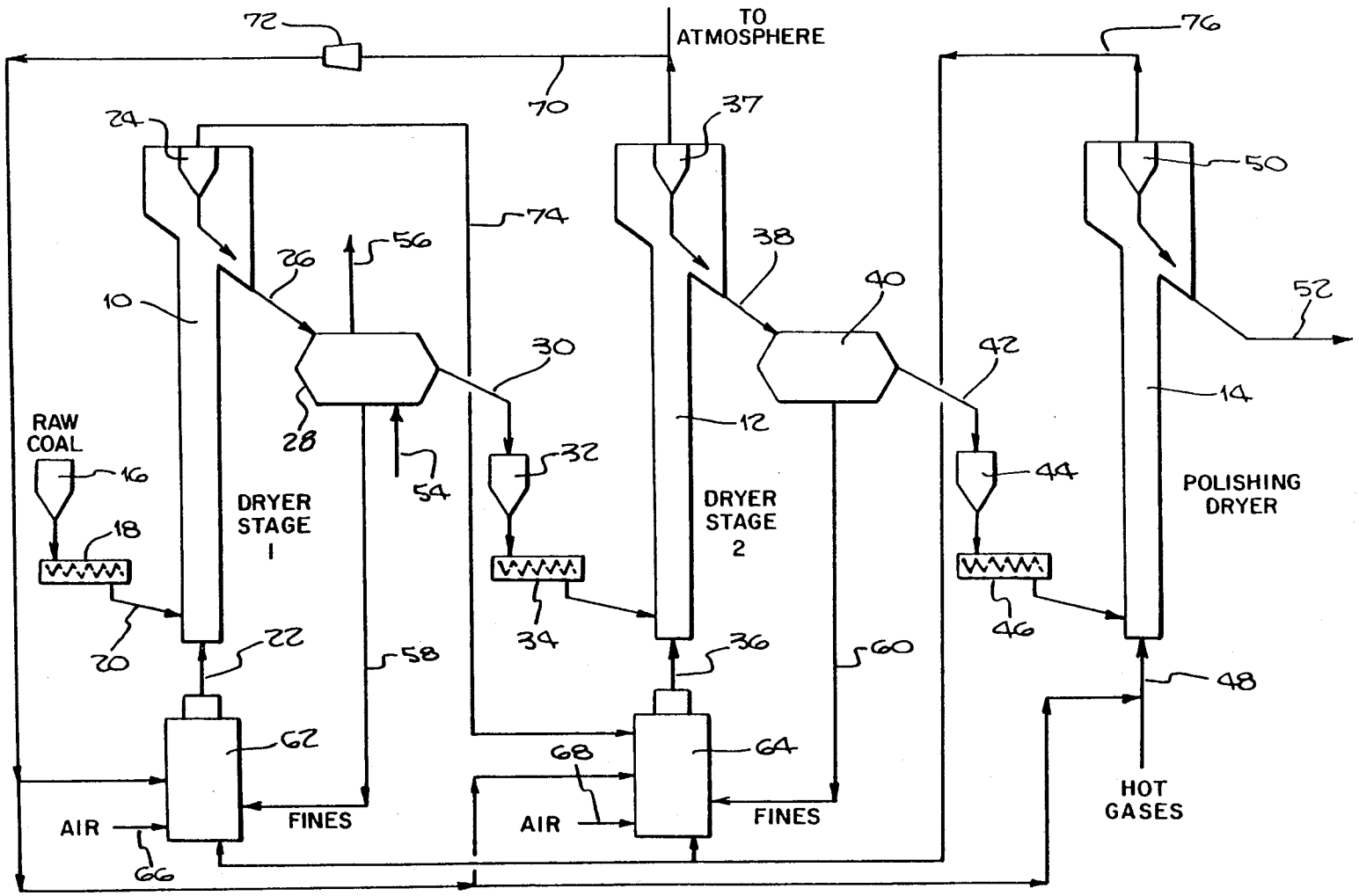
POLISHING DRYER
HOT GASES
DRYER STAGE 2
FINES
TO ATMOSPHERE
AIR
DRYER STAGE 1
FINES
AIR
RAW COAL

METHOD OF ENTRAINED FLOW DRYING

BACKGROUND OF THE INVENTION

The present invention relates generally to systems and processes for heat treating carbonaceous materials to recover hydrocarbon products. More specifically, the present invention relates to a process and system for removing moisture from carbonaceous materials prior to heat treatment by pyrolysis or otherwise.

Pyrolysis of carbonaceous materials such as oil shale and coal, is a process commonly in use for recovering valuable hydrocarbon products. Pyrolysis basically involves heating the carbonaceous material to elevated temperatures normally above 800° F. in a non-oxidizing atmosphere. The carbonaceous material is devolatilized or degraded at this temperature into various hydrocarbon products which are recovered. It has been found advantageous in pyrolysis systems to initially preheat the carbonaceous material to temperatures on the order of 500°-600° F. Many different types of preheat systems are presently being used ranging from moving bed or fluidized bed preheaters to staged preheat systems in which the carbonaceous material is entrained in a series of gas streams having gradually increasing temperatures.

Raw carbonaceous materials such as coal and oil shale generally include a certain amount of moisture. The amount of moisture generally ranges between 1 and 35 weight percent. Although it is possible to directly pyrolyze moist carbonaceous materials, it has been found desirable to initially remove moisture present in the carbonaceous material prior to pyrolyzing.

In order to provide a suitable drying process or system, the process must be capable of conveniently and efficiently drying large amounts of carbonaceous material in a minimum amount of time with little or no devolatilization or degradation of the carbonaceous material. Any number of well-known preheat type processes may be utilized in initially drying moist carbonaceous material. For example, fluidized beds, or rotating drums may be operated at mildly elevated temperatures to provide the desirable removal of moisture from the particulate material. In addition, the drying processes may include systems where the carbonaceous material is entrained in gas streams at elevated temperature.

In the gas stream entrainment type dryers, the total solids blend of particulate material, including a distribution of smaller and larger sizes, is exposed to contact with hot gases in a lift pipe or the like. Moisture and/or any solvent present evaporates from the material into the gas phase. Transfer of heat from the hot gases to the solids is a function of fluid flow, gas thermal properties, solids thermal properties, solid surface characteristics, temperature differences and gas-solid residence time. In the entrained flow-type system, the smaller particles achieve higher velocities and, as a result, the rate of heat transfer is greatest for these particles in any given section of the dryer.

Normally, the temperature of the particulate solids in the gas stream increases to the point at which the moisture begins to evolve. It should be pointed out that in this specification, the term moisture is intended to include not only aqueous moisture but solvent moisture of various types present in raw coal or oil shale which have vaporization temperatures below initial devolitilization temperatures. The evolution or vaporization of moisture continues at a relatively constant temperature until all of the moisture has evaporated from a given particle. The moisture may be uniformly distributed throughout the particles or may only be surface related. In any event, because of the rate of heat transfer to the smaller particles and their smaller total mass, they reach total dryness much sooner that the larger particles and rapidly approach contacting gas temperatures. In order to dry carbonaceous materials in a minimum amount of time, it is desirable to maintain contacting gas temperatures as high as possible. Accordingly, gas stream temperatures are maintained well above the devolatilization or degradation temperature of the carbonaceous material. As a result, in entrained flow-type dryers, the smaller particles are generally overheated and partially degraded or devolatilized resulting in loss of hydrocarbon product.

Although entrained flow-type drying systems are well-suited and particularly advantageous for removing moisture from particulate solids in a convenient and quick manner, it would be desirable to provide an improved entrained flow dryer in which hydrocarbon product losses due to overheating of smaller particles is reduced.

SUMMARY OF THE INVENTION

In accordance with the present invention, an improved process and system for entrained flow drying is provided where moisture present in raw carbonaceous material is reduced to low levels while avoiding degradation and devolatilization of smaller particles. The present invention has particular application to staged drying processes in which moist particulate carbonaceous material is entrained in one or more serially connected hot gas streams. The hot gas streams are typically at temperatures above the devolatilization temperature of the carbonaceous material. While in the individual gas streams, the carbonaceous material forms a solids blend of smaller relatively hot and dry particles and larger relatively cool and moist particles. The present invention involves entraining the solids blend of particles within each hot gas stream for a time sufficient to heat the smaller particles to a temperature which remains below the devolatilization temperature of the carbonaceous material. The solids blend is then separated from the gas stream and any moisture volatilized therein. This solids blend having particles of varying temperature is transferred to a contactor zone where the particles are intimately contacted for a sufficient amount of time to allow heat transfer from the smaller particles to the larger particles. As a result, the smaller particles are partially cooled and the larger particles are partially heated with all particles approaching a common equilibrium temperature. After reaching equilibrium temperature in the contactor, the solids blend may then be passed onto a second lift pipe where the process is repeated to remove additional moisture present.

As one particular feature of the present invention, the relatively hot and dry smaller particles present in the contactor are separated from the larger relatively cool and moist particles. Where combustible, the smaller dry particles or fines may be transferred to a combustor where they may be combusted to provide at least a portion of the heat necessary for operating the dryer/-preheat system.

As other particular features of the present invention, the contactor may be provided by a rotating drum, fluidized bed or fixed bed. Further, moisture-free gas is swept through the solids blend while present in the contactor to carry off any vaporized moisture present. The use of sweeping gas in the contactor prevents condensation of moisture on the cooling particles.

As an additional feature of the present invention, the lift pipes may be constructed to provide maximum residence time for the larger particles. This is especially important where large temperature differences may exist between the smaller and larger particles. This particular feature of the present invention is accomplished by increasing the crosssectional diameters in the lower portions of the lift pipes.

Taken as a whole, the improved staged entrained flow dryer of the present invention provides a convenient, effective and relatively quick means for drying moist carbonaceous materials while at the same time minimizing the amount of hydrocarbon product loss through degradation or devolatilization of the smaller sized particulate material.

The above-discussed and many other features and attendant advantages of the present invention will become apparent as the invention becomes better understood by reference to the following detailed description when considered in conjunction with the accompanying drawing.

BRIEF DESCRIPTION OF THE DRAWING

The drawing is a diagrammatic representation of a preferred process and system in accordance with the present invention where drying is carried out in three stages.

DETAILED DESCRIPTION OF A PREFERRED EXEMPLARY EMBODIMENT

A schematic representation of a preferred dryer system in accordance with the present invention is shown in the drawing. The preferred dryer system is a three-stage entrained-flow flash dryer. The system includes a first dryer lift pipe 10, second dryer lift pipe 12, and third or polishing dryer lift pipe 14. Although more or less lift pipes or stages may be utilized in drying moist carbonaceous material depending upon moisture content of the material and system operating conditions, the three lift pipe system disclosed hereinafter has been found particularly useful for removing normal amounts of moisture generally found in raw carbonaceous material.

Basically, raw moist carbonaceous material such as coal or oil shale is introduced from hopper 16 into screw feeder 18. The raw moist and particulate material is transferred through line 20 to the lower end of lift pipe 10. A first hot gas stream is introduced into lift pipe 10 through gas line 22. The carbonaceous material is entrained in the hot gas stream resulting in heat transfer and formation of an entrained solids blend having smaller relatively hot and dry particles and larger relatively cool and moist particles. The solids blend is separated from the gas stream and vaporized moisture by separation means such as cyclone 24. The solids blend is then passed through transfer line 26 to a first contactor 28. In the contactor 28, the smaller relatively hot and dry particles and the larger relatively cool and moist particles are intimately contacted to allow heat transfer from the smaller particles to the larger particles resulting in partial cooling of the smaller particles and concurrent partial heating of the larger particles. After partial cooling and heating of respectively sized particles, the temperature equilibrated solids blend is transferred from the first contactor 28 through outlet line 30 to a second hopper 32. The partially dried material is then transferred by way of screw feeder 34 to the lower end of the second lift pipe 12.

A second hot gas stream is introduced into the lower end of second lift pipe 12 through gas line 36. The partially dried particulate material is entrained in the second gas stream with heat transfer again occurring based partially upon particle sizes. Again, the relatively smaller particles become hotter and drier more quickly than the relatively large particles which remain relatively cool and moist relative to the smaller particles. This second solids blend of particles of varying temperature is separated from the second gas stream and vaporized moisture by cyclone 37. The separated second solids blend is transferred through outlet line 38 to a second contactor 40. Again, in second contactor 40, the variously sized particulate material is intimately contacted to allow heat transfer and partial cooling of the smaller particles and partial heating of the larger particles. After an equilibrium temperature has been reached by the variously sized particles they are then passed onto the third and final stage of the drying system.

The solids blend from contactor 40 is transferred through inlet line 42 to the third hopper 44. This solids blend which has the majority of moisture removed therefrom is then passed by way of screw feeder 46 to the lower end of the third or polishing lift pipe 14. A third hot gas stream is introduced into the lower end of third lift pipe 14 by way of gas line 48. As the solids blend is entrained and lifted upward in the third gas stream, substantially complete moisture removal is accomplished. Cyclone 50 is provided for separating the solids blend from the gas stream and any vaporized moisture. The solids is then passed out of the third lift line 14 through outlet 52 for further preheating and pyrolysis. If the particular carbonaceous material being dried still contains moisture when it is removed through outlet 52, additional lift pipe stages may be included where desirable. However, it is expected that for most situations, the three lift pipes will be sufficient to dry the majority of carbonaceous material with process conditions and parameters, such as gas temperatures, flow rates and residence times, being varied to insure complete moisture removal in the three stages provided.

The present invention is applicable to particulate carbonaceous material and is especially useful for drying coal and oil shale. Although the particle size and distribution within any particular sample is not critical, it is preferred that the raw moist material which is fed to the present system is crushed to a normal size of ½ inch or smaller. Particles in this size range are preferred since they allow adequate entrainment of the particles in gas streams having velocities normally employed in lift pipe systems. Although the particular size distribution of the particulate material dried in accordance with the present invention is not critical, the particular size distribution should be taken into account when determining residence times, temperatures and other parameters.

The temperatures of the hot gas streams is not particularly critical. It is important, however, that the temperature and flow rate of the gas streams be maintained so that the majority of smaller sized particles in the solids blend do not reach temperatures above coal or oil shale degradation temperatures. On the other hand, it is desirable to provide gas streams having as high a temperature as possible in order to shorten the drying process if possible. Typically, inlet gas temperatures ranging from 500°-1400° F. are preferred. Even more preferably, inlet gas temperatures in the range of 800°-1300° F. are preferred. At these temperatures, gas stream flow rate and residence time of particles within the lift pipes is regulated to insure overheating of the small particles does not occur. Typical gas velocities will be from 60-100 ft/sec. The gas velocity is designed to entrain solids above terminal velocity of the largest particles. This velocity may be varied in appropriate lift pipe sections to optimize residence times of particles of interest coincident with temperature driving forces. Particle velocities will be in the range of 10-120 ft/sec. with residence time in the lift pipes on the order of 10-10,000 milliseconds.

The contactors 28 and 40 may be provided by any convenient apparatus designed to intimately mix particulate solids. Rotating drums in which the particulate solids are continually cascaded and mixed are suitable. Further, fixed bed arrangements and fluidized beds may also be used. When using a rotating drum or fixed bed contactor, it is preferable to pass dry sweeping gas through the particulate solids blend. For example, as shown in the drawing, dry sweeping gas is passed through inlet line 54 into contactor 28. As the sweeping gas passes through the contactor 28, it picks up any moisture present. This prevents condensation of moisture on particles which are partially cooling. The moisture-laden sweeping gas is then removed from the contactor through line 56. The same type of sweeping gas arrangement may be utilized for contactor 40 if a rotating drum or fixed bed type contactor is utilized. However, if a fluidized bed type contactor is utilized, sweeping gas is not necessary since the fluidizing gas utilized to maintain the solids blend in a fluidized state serves as the sweeping gas. Gas flows in the contactor should be in the 0-30 ft/sec. range and residence times may vary from 10 to 120 minutes.

As a particular feature of the present invention, provision is made for separating out those smaller particles within the contactor that are substantially dry. In this way, smaller particles (i.e. especially fines) which require no further drying are removed from the system and therefore result in lower heat requirements for subsequent stages. Any suitable separator such as a cyclone separator may be utilized to separate out the smaller, dry particles. Further, the particles may be classified by their moisture content to insure that the majority of the removed smaller particles are in fact substantially moisture-free.

Referring to the drawing, the smaller dry particles are removed from the contactor after separation through lines 58 and 60 for contactors 28 and 40 respectively. Although the removed fines may be passed to the preheating system for further preheating or to other processing apparatus, it is particularly preferred where necessary that the fines be combusted in combusters 62 and 64 to provide at least a portion of the heat necessary for the hot gas streams. Combustion air for the combustors 62 and 64 is introduced through lines 66 and 68 respectively. Preferably the fines are combusted in combustor 62 and 64 at temperatures around 3000° F. Gas streams at these high temperatures may in certain circumstances not be desirable in the drying system. Accordingly, hot gases from all three lift pipes are recycled to the combustors. These recycle gases which are at a much lower temperature than the combustion gases dilute and lower the temperature of the gas streams when desired. The temperature in the various lift pipes may therefore be regulated simply by controlling the amount of combusted fines and recycle gases. For example, hot gas at a temperature in the range of 300°-1000° F. which exits the second lift pipe 12 through line 70 may be cycled by way of blower 72 to combustors 62 and 64 and additionally directly into the third lift pipe 14. Further, hot gases exiting the first lift pipe 10 may be cycled to combustor 64 as shown by line 74. In addition, hot gases exiting the third lift pipe through line 76 may also be recycled to combustors 62 and 64. This recycling of flue gas not only conserves heat within the drying system, but additionally reduces oxygen content of the gas streams to low levels on the order of 3 percent by volume. These low levels of oxygen help to prevent rapid oxidation of dried material within the lift pipes. In this manner, highly pyrophoric materials may be safely dried and possibly passivated. Further as discussed above, the recycling of flue gases serves as a temperature-moderating stream for controlling temperature of the gas streams within the lift pipes.

The following is an example of a process in accordance with the present invention.

A solids blend of particles having a size distribution as set forth in Table I is entrained in a lift pipe having six serially connected 12 foot stages with 84 inch diameters. The entraining gas is at a temperature of 800 degrees F. and a gas velocity of 69.0 ft/sec. Inlet gas pressure is 16.00 lbs/sq. in absolute pressure.

The solids blend when introduced into the lift pipe is at a temperature of 70 degrees F. with an average moisture content of 9 percent. See Table II. The moisture content and temperature breakdown for each solids fraction at the exit end of each of the six 12 foot stages or portions of the lift pipe is given in Table III. $H_2O$ content is in percent moisture by weight and temperature is in degrees F. As can be seen, the smallest particles quickly loose all their moisture and are heated to relatively high temperature levels resulting in volatilization of valuable products. In accordance with the present invention one or more accumulators or contactors are included between one or more of the stages, or between this lift pipe and subsequent lift pipes to provide re-distribution of moisture and heat between the variously sized particles to reduce the effects of the uneven heating disclosed in Table III.

TABLE I

| Particle Size | Fraction |
|---|---|
| 0.3710 | 0.1729 |
| 0.2630 | 0.1130 |
| 0.1850 | 0.1470 |
| 0.1310 | 0.1180 |
| 0.0930 | 0.1200 |
| 0.0460 | 0.1560 |
| 0.0232 | 0.0860 |
| 0.0116 | 0.0480 |
| 0.0041 | 0.0400 |

TABLE II

| Particle Size | $H_2O$ | Temp. |
|---|---|---|
| 0.3710 | 0.09 | 70.0 |
| 0.2630 | 0.09 | 70.0 |
| 0.1850 | 0.09 | 70.0 |
| 0.1310 | 0.09 | 70.0 |
| 0.0930 | 0.09 | 70.0 |
| 0.0460 | 0.09 | 70.0 |
| 0.0232 | 0.09 | 70.0 |
| 0.0116 | 0.09 | 70.0 |

TABLE II-continued

| Particle Size | $H_2O$ | Temp. |
|---|---|---|
| 0.0041 | 0.09 | 70.0 |

TABLE III

| | 1st Stage Exit | | 2nd Stage Exit | | 3rd Stage Exit | |
|---|---|---|---|---|---|---|
| Particle Size | Temp. | $H_2O$ | Temp. | $H_2O$ | Temp. | $H_2O$ |
| 0.2630 | 151.9 | 0.09 | 167.3 | 0.08 | 168.2 | 0.07 |
| 0.1850 | 163.2 | 0.09 | 167.3 | 0.08 | 168.2 | 0.07 |
| 0.1310 | 166.0 | 0.09 | 167.3 | 0.07 | 168.2 | 0.06 |
| 0.0930 | 166.0 | 0.08 | 167.3 | 0.06 | 168.2 | 0.04 |
| 0.0460 | 166.0 | 0.03 | 187.0 | 0.0 | 265.4 | 0.0 |
| 0.0232 | 284.9 | 0.0 | 394.7 | 0.0 | 436.8 | 0.0 |
| 0.0116 | 482.3 | 0.0 | 524.7 | 0.0 | 511.7 | 0.0 |
| 0.0041 | 596.7 | 0.0 | 534.3 | 0.0 | 495.3 | 0.0 |
| | 4th Stage Exit | | 5th Stage Exit | | 6th Stage Exit | |
| Particle Size | Temp. | $H_2O$ | Temp. | $H_2O$ | Temp. | $H_2O$ |
| 0.2630 | 169.0 | 0.07 | 169.8 | 0.06 | 170.4 | 0.05 |
| 0.1850 | 169.0 | 0.06 | 169.8 | 0.05 | 170.4 | 0.04 |
| 0.1310 | 169.0 | 0.05 | 169.8 | 0.04 | 170.4 | 0.03 |
| 0.0930 | 169.0 | 0.02 | 169.8 | 0.01 | 188.7 | 0.0 |
| 0.0460 | 313.7 | 0.0 | 344.5 | 0.0 | 363.7 | 0.0 |
| 0.0232 | 451.2 | 0.0 | 451.1 | 0.0 | 443.4 | 0.0 |
| 0.0116 | 486.8 | 0.0 | 461.9 | 0.0 | 440.0 | 0.0 |
| 0.0041 | 466.9 | 0.0 | 444.1 | 0.0 | 425.0 | 0.0 |

Having thus described an exemplary embodiments of the present invention, it should be noted by those skilled in the art that the within disclosures are exemplary only and that various other alternatives, adaptations and modifications may be made within the scope of the present invention. Accordingly, the present invention is not limited to the specific embodiments as illustrated herein.

What is claimed is:

1. In a process for staged drying of moist particulate carbonaceous material wherein said carbonaceous material is entrained in a plurality of serially connected hot gas streams having temperatures above the devolatilization temperature of said carbonaceous material, said carbonaceous material while in said gas streams forming a solids blend of smaller relatively hot and dry particles and larger relatively cool and moist particles, wherein the improvement comprises:

entraining said solids blend within each said hot gas stream for a time sufficient to heat said smaller particles to a temperature below the devolatilization temperature of said carbonaceous material;

separating the solids blend from said gas stream and any moisture contained therein;

transferring the solids blend to a contactor zone prior to transfer to the next hot serially connected gas stream; and contacting said relatively hot smaller particles with said relatively cool larger particles for a sufficient amount of time to allow heat transfer from said smaller particles to said larger particles whereby said smaller particles are partially cooled and said larger particles are partially heated such that said smaller and larger particles obtain a final temperature within the contactor zone which is below the temperature of the smaller particles at the time the smaller particles enter the contactor zone to thereby prevent overheating and devolatilization of said smaller particles when the solids blend is passed to said next serially connected hot gas steam.

2. An improved staged drying process according to claim 1 wherein three serially connected hot gas streams are utilized to dry said moist carbonaceous material.

3. An improved staged drying process according to claim 1 further including the step of separating substantially dry smaller particles from larger particles still containing moisture in said contactor zone whereby said substantially dry particles are not further heated by entrainment in the next serially connected hot gas stream.

4. An improved staged drying process according to claim 3 wherein said substantially dry particles are combusted to provide at least a portion of the heat for heating one or more gas streams to form one or more of said hot gas streams.

5. An improved staged drying process according to claim 3 wherein substantially all of the smaller particles are separated from the larger particles and not further heated.

6. An improved staged drying process according to claim 5 wherein said separated smaller particles are combusted in a combustion zone.

7. An improved staged drying process according to claim 1 wherein said smaller particles are heated to a temperature of between about 250 degrees F. and 350 degrees F.

8. An improved staged drying process according to claim 7 wherein the temperatures of said hot gas streams are between about 500 degrees F. and 1400 degress F.

9. An improved staged drying process according to claim 1 wherein said contactor zone is defined by the walls of a rotating drum.

10. An improved staged drying process according to claim 1 wherein said contacting of said smaller hot and larger cool particles is carried out in a moving bed.

11. An improved staged drying process according to claims 9 or 10 which includes passing dry sweeping gas through said contactor zone to entrain moisture therein and prevent condensation of said moisture on the partially cooling smaller hot particles.

12. An improved staged drying process according to claim 1 wherein contacting of said smaller hot and larger cool particles is carried out in a fluidized bed.

13. An improved staged drying process according to claim 1 wherein said relatively hot smaller particles are contacted with said relatively cool larger particles for a sufficient time to substantially equalize the temperature of said smaller and larger particles.

14. A process for drying moist particulate carbonaceous material comprising the steps of:

entraining the carbonaceous material in a hot gas stream having a temperature above the devolatilization temperature of said carbonaceous material for a sufficient amount of time to provide a partially dried solids blend of carbonaceous material having smaller relatively hot and dry particles and larger relatively cool and moist particles, said smaller particles being heated to a temperature below the devolatilization temperature of said carbonaceous material;

separating said solids blend from said hot gas stream and any moisture entrained therein;

transferring said partially dried solids blend to a contactor zone;

contacting said smaller relatively hot and dry particles and larger relatively cool and moist particles for a sufficient amount of time in said contactor zone to allow heat transfer from said smaller particles to said larger particles whereby said smaller particles are partially cooled and said larger particles are partially heated to a common equilibrium temperature which is below the temperature of the smaller particles at the time the smaller particles enter the contactor zone;

transferring the solids blend from said contactor zone to a second hot gas stream having a temperature above the devolatilization temperature of said carbonaceous material; and repeating the preceding process until substantially all of the particulate solids are dried.

15. A process according to claim 14 in which said process is repeated three times to provide entrainment of said particulate material in three hot gas streams.

16. A process according to claim 14 further including the step of separating substantially dry smaller particles from larger particles still containing moisture in said contactor zone whereby said substantially dry particles are not further heated by subsequent entrainment in said second hot gas stream.

17. A process according to claim 16 wherein said separated dry particles are combusted to provide at least a portion of the heat for said hot gas streams.

* * * * *